US006817729B2

(12) United States Patent
Lebel

(10) Patent No.: US 6,817,729 B2
(45) Date of Patent: Nov. 16, 2004

(54) BEACON SYSTEM WITH ENHANCED INSULATION AND SEALING

(75) Inventor: Patrick Lebel, Villeneuve Loubet (FR)

(73) Assignee: Augier S.A., Carros Cedex (FR)

( * ) Notice: Subject to any disclaimer, the term of this patent is extended or adjusted under 35 U.S.C. 154(b) by 61 days.

(21) Appl. No.: 10/343,642

(22) PCT Filed: Aug. 3, 2001

(86) PCT No.: PCT/FR01/02551

§ 371 (c)(1),
(2), (4) Date: Feb. 3, 2003

(87) PCT Pub. No.: WO02/13213

PCT Pub. Date: Feb. 14, 2002

(65) Prior Publication Data

US 2003/0169589 A1 Sep. 11, 2003

(30) Foreign Application Priority Data

Aug. 4, 2000 (FR) ..... 00 10409

(51) Int. Cl.[7] ..... E01F 9/00; H05B 41/16; H01R 25/00

(52) U.S. Cl. ..... 362/153.1; 362/227; 315/277; 315/255; 439/651

(58) Field of Search ..... 362/153.1, 227, 362/219; 315/277–279, 255; 439/75, 651

(56) References Cited

U.S. PATENT DOCUMENTS 551,882 A * 12/1895 Whiteman, Jr. et al. ..... 256/35
5,899,773 A * 5/1999 Cheng ..... 439/651
6,111,772 A * 8/2000 Lee et al. ..... 363/146
6,206,733 B1 * 3/2001 Wu ..... 439/651

FOREIGN PATENT DOCUMENTS

| | | |
|---|---|---|
| DE | 295 01 351.6 | 5/1995 |
| DE | 299 09 011 | 9/1999 |
| EP | 0 196 249 | 10/1986 |
| EP | 0 836 260 | 4/1998 |
| GB | 2 160 368 | 12/1985 |

* cited by examiner

*Primary Examiner*—Alan Cariaso
*Assistant Examiner*—Ali Alavi
(74) *Attorney, Agent, or Firm*—James C. Lydon

(57) ABSTRACT

A airport runway lighting system, including a power source (10) supplying a constant current to a primary circuit (12) and several marking lights (14-1 to 14-6) each being connected to the primary circuit by a current transformer (16-1 to 16-6), the secondary winding of which supplies the lamp current. At least several adjacent transformers form a multiple assembly without a connection cable. Each transformer features a built-in male connector and a female plug or two built-in female plugs. The transformers are stacked to form the multiple assembly, the male connector of one of the transformers being inserted into the female plug of the immediately adjacent transformer, the male connector of the first transformer and the female plug of the last transformer being connected in series to the primary circuit.

12 Claims, 4 Drawing Sheets

BEACON SYSTEM WITH ENHANCED INSULATION AND SEALING

This application is a U.S. National Stage of International application PCT/FR01/02551, filed Aug. 3, 2001.

TECHNICAL FIELD

This invention concerns runway lighting systems in which the marking lights are arranged in series along a looped primary circuit and specifically concerns a runway lighting system with reinforced insulation and waterproofing.

BACKGROUND ART

The runway lighting system used on airport runways generally consists of a looped primary circuit in series along which are connected marking lights powered by alternating current whose root mean square value is set by a constant current regulator depending on the desired brightness.

The marking lights are each isolated from the primary circuit by means of a marking light transformer whose essential characteristics are standardized. These current transformers are encapsulated in rubber and feature primary connection cords, on the supply side, as well as secondary connection cords, on the light side.

Several transformers of this type are generally installed in manholes which are in fact cavities in the ground next to the runway. A manhole can include up to 8 transformers as well as other additional equipment.

While drained, the manholes in which several transformers are installed are sometimes filled with rain water or run-off. As the transformers are placed in the manhole every which way, after a certain time in service and following maintenance, the length of the primary and secondary connection cords become a tangle of cables immersed and covered in mud which has accumulated over time in the bottom of the manhole.

The connections thus hang in the bottom of the manhole and consequently, even though the transformers are not in the water, the connectors and all of the cables are immersed in the bottom of the manhole.

The arrangement described above results in a certain number of major drawbacks. Firstly, the tangled cables increase the risk of connectors and plugs becoming disconnected. Even more so, as the equipment in the bottom of the manhole is often immersed and covered in mud, the identification of cables in relation to the transformers is difficult and represents a source of error when searching for the loop concerned, which can lead to wasted time, additional tests and possible damage.

Moreover, added to the fact that the encapsulation rubber and over-molding have a certain porosity which degrades with age, the major drawback is the poor watertightness of the connections. The penetration of water into the primary connectors leads to links with the ground which could damage the insulation or, through migration, destroy the transformer itself. The infiltration of water into the secondary connectors and plugs could lead to a certain derivation of the lamp current.

DISCLOSURE OF THE INVENTION

This is why the general purpose of the invention is to supply a reinforced insulated and waterproof runway lighting system by grouping the transformers located in each manhole into one single assembly.

Another purpose of the invention is to supply a runway lighting system in which each transformer features one male connector and one female plug so that several transformers can be grouped together to form a single multiple assembly mounted on the wall of the manhole.

The purpose of the invention is a runway lighting system, namely for an airport runway, including a power source supplying a constant current to a primary circuit and a plurality of marking lights connected respectively to the primary circuit by a plurality of current transformers, the secondary winding of which supplies the lamp current. A given number of adjacent marking lights are connected to the primary circuit respectively by a given number of transformers forming a multiple assembly without interconnecting cable, each transformer forming a single block having a male connector and a female plug. The transformers are stacked together to form the multiple assembly, the male connector of one of the transformers being inserted into the female plug of the immediately adjacent transformer. The multiple assembly is mounted in series in the primary circuit by means of two primary cords connected to the male connector of the first transformer of the multiple assembly and the female plug of the last transformer of the multiple assembly, respectively.

BRIEF DESCRIPTION OF DRAWINGS

The purposes, objects and characteristics will become more apparent from the following description when taken in conjunction with the accompanying drawings in which.

DETAILED DESCRIPTION OF THE INVENTION

Figure 1:
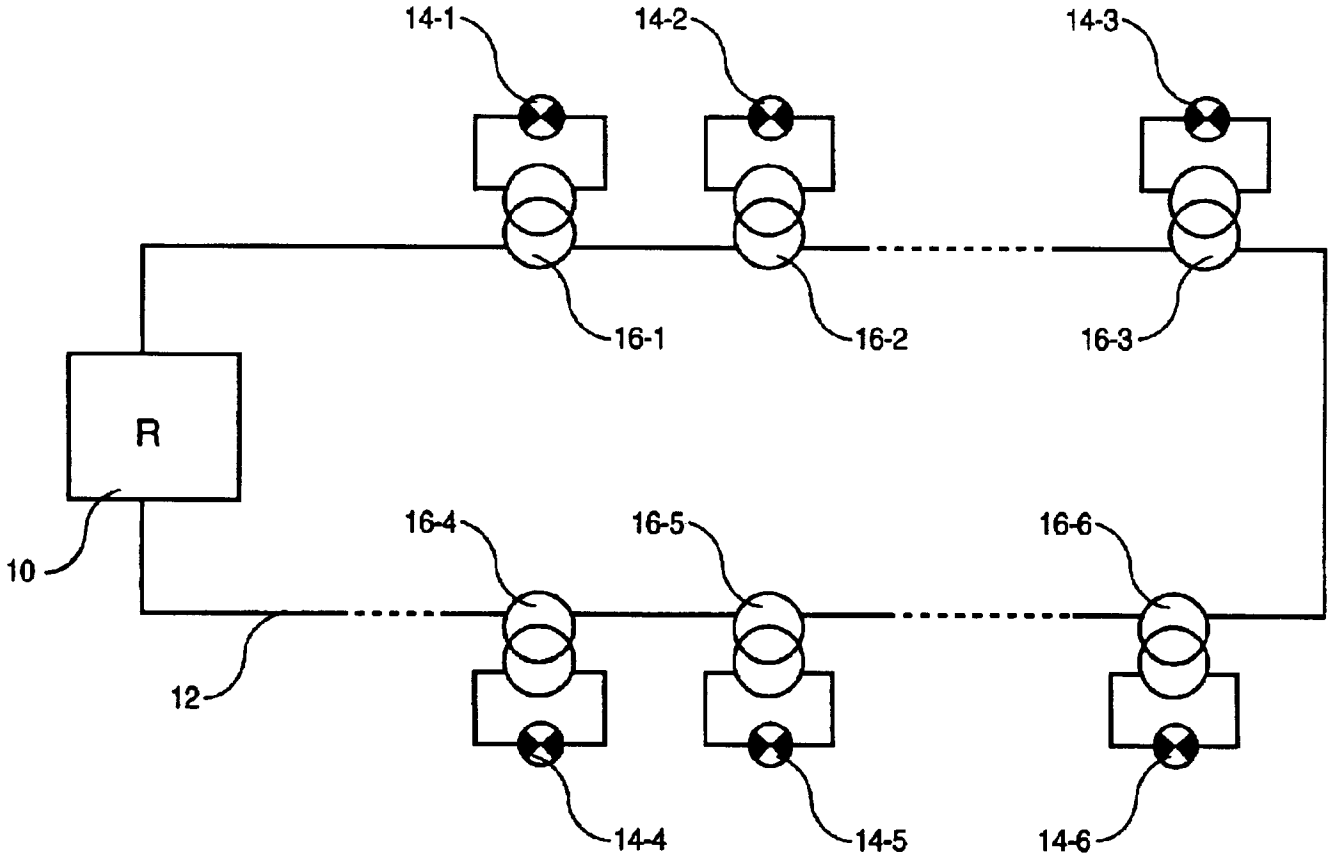
FIG. 1 represents a runway lighting loop in which the system of the invention is used.

The runway lighting system according to the invention used primarily for airport runways is depicted in FIG. 1. A current regulator 10 supplies a constant current, 6.6A for example, to the primary circuit 12. The marking lights 14-1, 14-2, 14-3, 14-4, 14-5, and 14-6, are powered by the secondary circuits of the marking transformers 16-1, 16-2, 16-3, 16-4, 16-5, and 16-6 respectively, the primary windings of which are connected in series to the primary circuit 12. It should be noted that the transformers 16 are current transformers with a ratio of 1/1. In the example shown in the figures, these transformers are toroidal transformers which may also be EI type transformers.

Figure 2A:
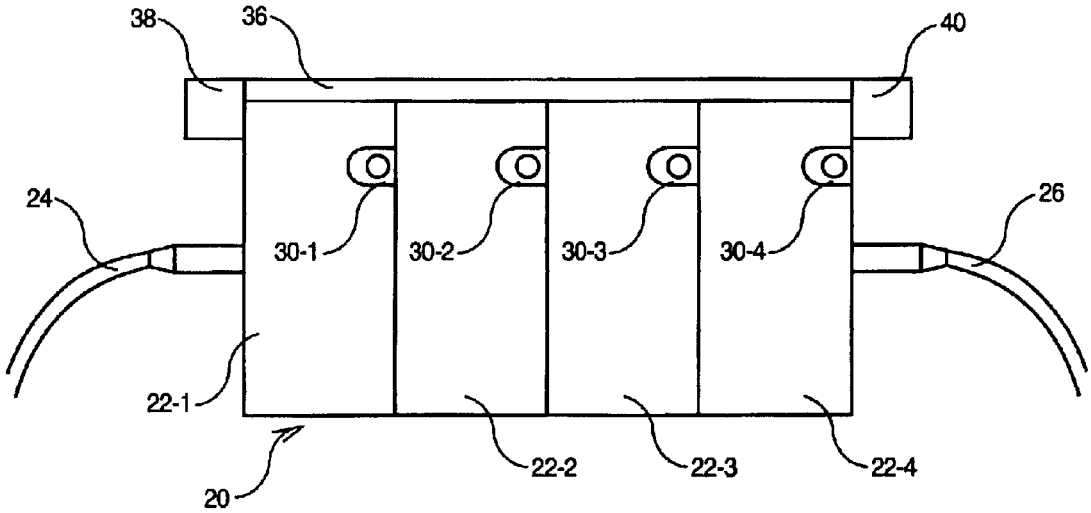
FIG. 2A represents a front view of a multiple transformer assembly according to the invention.

The transformers 16 are grouped in manholes or cavities along the runway. According to the invention, a group may consist of a plurality of transformers forming a multiple assembly. In this manner, according to the example illustrated in FIGS. 2A and 2B, such a multiple assembly may include 4 transformers 22-1, 22-2, 22-3, and 22-4 arranged in an adjacent manner without primary cords except for the primary cord 24 and primary cord 26 connected to the ends of the loop cable in the manhole so as to connect the multiple assembly 20 to the multiple assemblies located in the two adjacent manholes.

Figure 2B:
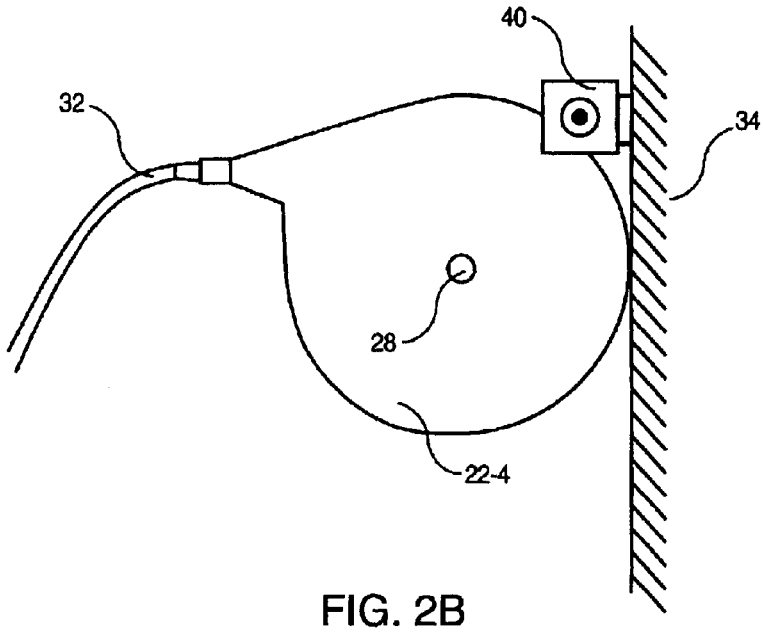
FIG. 2B represents a side view of the multiple transformer assembly according to the invention.

The corresponding male connectors and female plugs of adjacent transformer pairs are connected in the same alignment corresponding to the axis 28 of the torus illustrated in FIG. 2B. A secondary female plug base 30-1, 30-2, 30-3, and 30-4 is molded on each of the transformers 22-1, 22-2, 22-3, and 22-4 respectively, with the result that one simply has to plug in the secondary cord coming from the lamp, for example the secondary cord 32 for the transformer 22-4. A label holder or any other similar device is used to identify each transformer and its secondary connection.

Finally, the multiple assembly 20 is attached to the vertical wall 34 of the manhole, and preferably in the upper part of the manhole, by a spacer 36 featuring two nut blocks 38 and 40 secured to the wall 34 and tightened so as to maintain the transformers of the assembly together. It goes without saying that the cohesion of the multiple assembly as well as its attachment can be accomplished by any other means without deviating from the scope of the invention.

Figure 3:
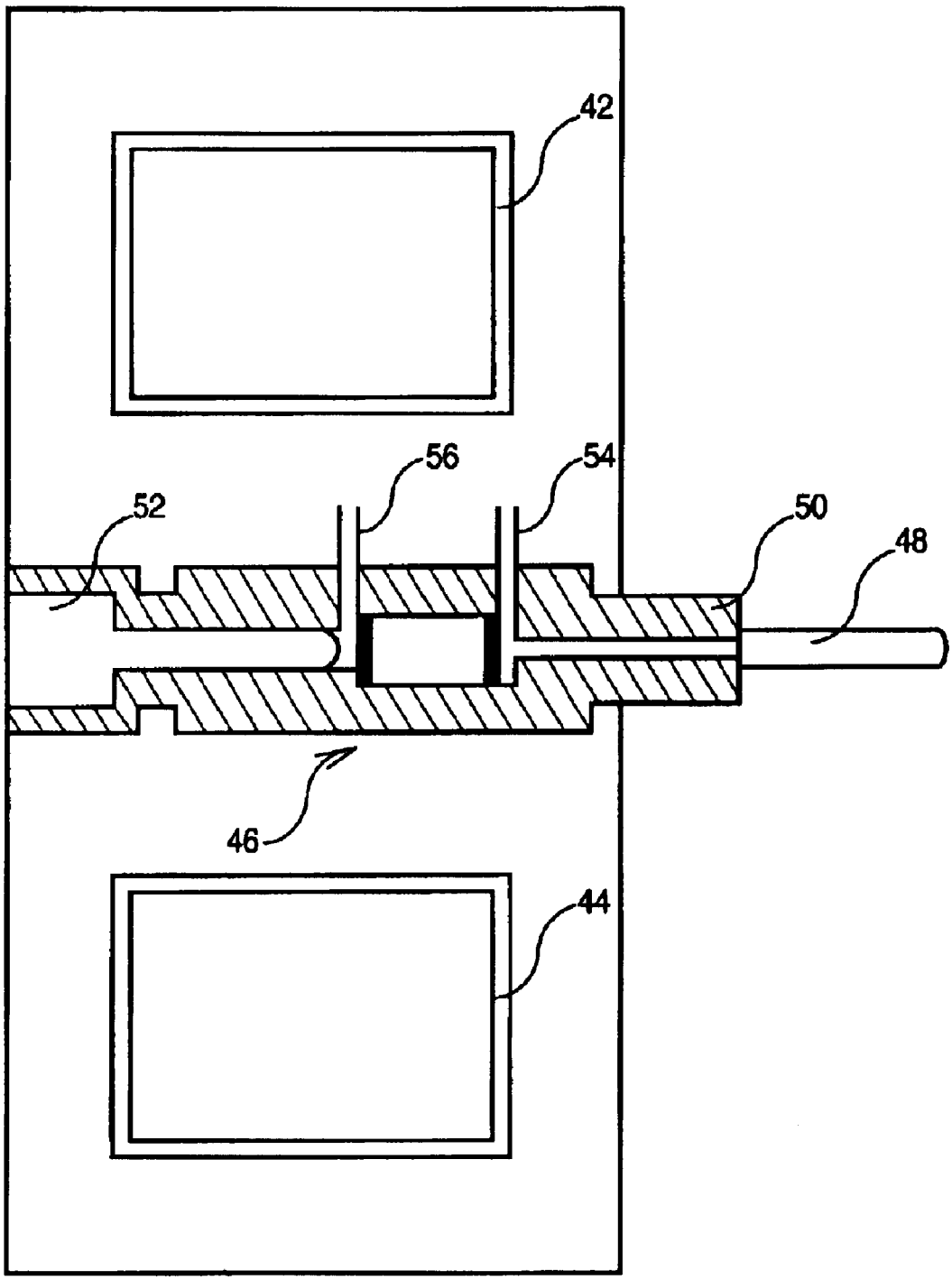
FIG. 3 represents a cross-section of a transformer according to a first embodiment of the invention showing the male and female connectors installed.

According to a first embodiment of the invention, each transformer of the multiple assembly 20 has the same cross section as illustrated in FIG. 3. The windings 42 and 44 forming the two parts of the torus are located on either side of a connection assembly 46 passing through the transformer and over-molded in the part of the transformer located along the axis of the torus. This connection assembly 46 includes a male connector 48 and its rubber base 50 and a hollow female plug 52, the shape of which contours the shape of the male plug 48 and its base 50. In this manner, the connection of two adjacent transformers is made by introducing the male connector 48 and the base 50 of the first transformer into the female plug 52 of the second transformer. The male connector 48 is connected to a copper conductor 54 and the bottom of the female plug is connected to a copper conductor 56 so that the insertion of the male connector 48 of an adjacent transformer results in the electrical contact between the conductor 54 of said transformer and the conductor 56 of the adjacent transformer. The two conductors 54 and 56 of the same transformer are connected respectively to the two ends of the transformer's primary winding. It should be noted that the male connector may be integrated on either side of the transformer and conversely for the female plug.

Figures 4, 4A:
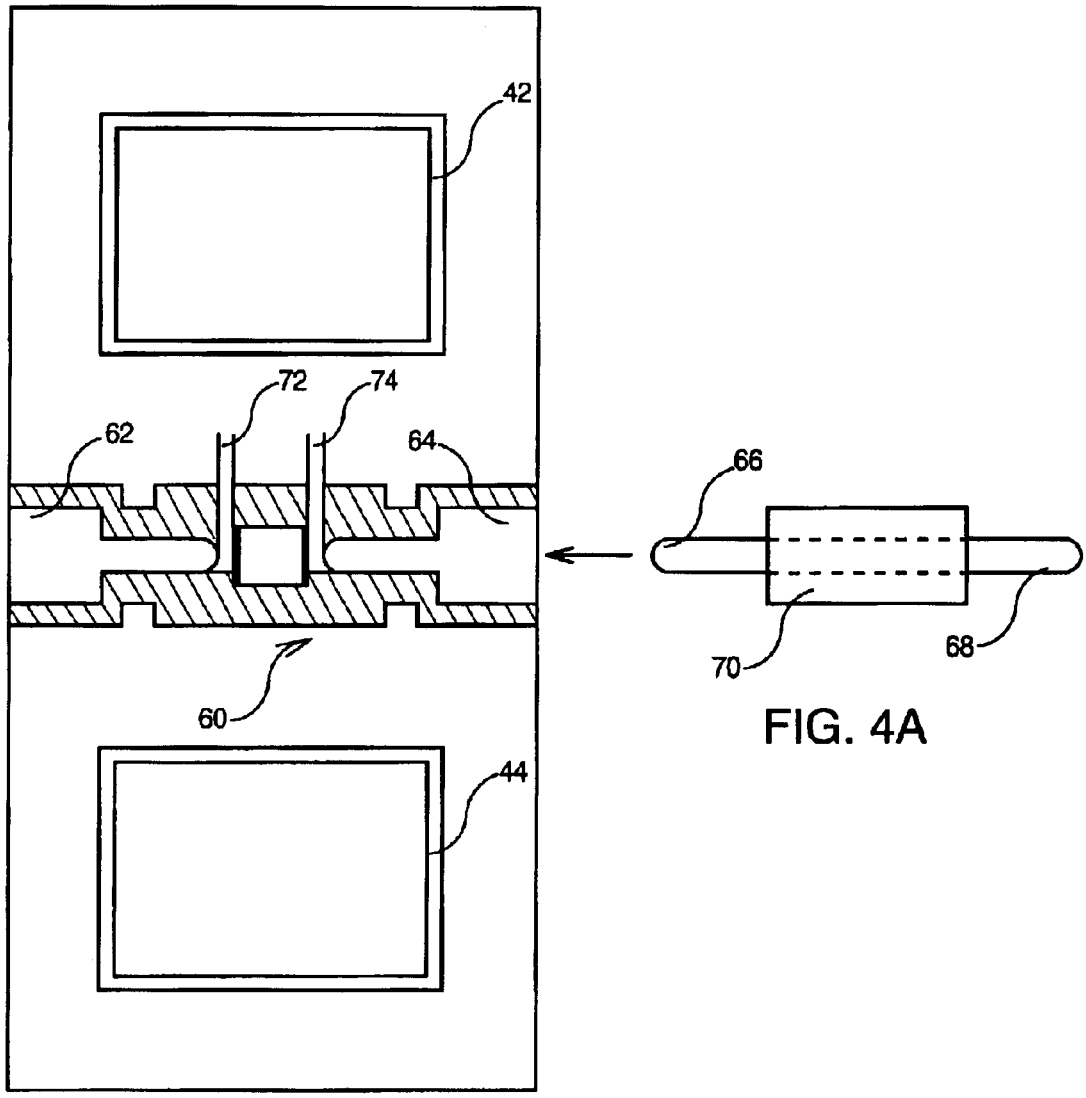
FIG. 4 represents a cross-section of a second embodiment of the invention showing the two built-in female plugs.
FIG. 4A represents a double male connector adapted to transform one of the two female plugs of the transformer illustrated in FIG. 4A into a male connector.

According to a second embodiment illustrated as a cross-sectional view in FIG. 4, the connection assembly 60 molded onto the part of the transformer located in the axis of the torus formed by the windings 42 and 44 includes two female plugs 62 and 64 located on the two opposite faces of the transformer. The connection of two adjacent transformers is made by means of a double male connector illustrated in the cross-sectional view in FIG. 4A. This double male connector consists of two male connectors 66 and 68 on each side and a cylindrical unit 70, preferably made of rubber. Owing to this double male connector, either of the female plugs 62 or 64 can be transformed into male connector by introducing one of the male connectors 66 or 68 into the selected female plug. The cylinder 70 serves as a base which butts up against the shoulder located on the inside of the female plug when the male connector is correctly inserted so as to establish the electrical connection with one of the copper conductors 72 or 74 connected to the ends of the transformer's primary winding.

The embodiment described above, in which the user has the possibility to select on which side of the transformer the male connector is placed, enables a multiple assembly to be installed in a manhole without first knowing on which side of the manhole the male primary cord or the female primary cord are located. The installer simply has to place a double male connector on the appropriate side of each transformer of the multiple assembly after having determined the respective positions of the male and female primary cords. Without this possibility, it could turn out that the transformers of the multiple assembly brought by the installer are not adapted to the manhole and that the installer must go back to get the adequate transformers often located a great distance from the manhole.

It should be noted that a lamp may be built into each transformer so that it comes on when the transformer is connected to the primary circuit. This would allow an installer to avoid handling a transformer assembly connected to the primary circuit and thus energized.

Owing to its block-shaped configuration made up of several transformers placed side by side, the invention does away with cords between the transformers and thus avoids possible tangling of the primary cables. In addition, the primary cords can no longer fall into the bottom of the manhole, often full of rain and run-off water (and mud). The watertight connection interfaces are thus always located above water. The only mobile cables are the connection cables to the primary circuit which are at the same height as the transformers and thus also above water.

What is claimed is:

1. A airport runway lighting system comprising a power source supplying a constant current to a primary circuit and a plurality of marking lights connected respectively to said primary circuit by a plurality of current transformers, the secondary winding of which supplies the lamp current, wherein a given number of adjacent marking lamps are connected to said primary circuit respectively by a given number of said transformers forming a multiple assembly without connection cable, each transformer forming a single unit featuring a male connector and a female plug and said transformers being stacked together to form said multiple assembly, said male connector of one of the transformers being inserted into said female plug of the immediately adjacent transformer, and wherein said multiple block is mounted in series in said primary circuit by means of two primary cords connected to the male connector of the first transformer of said multiple assembly and the female plug of the last transformer of said multiple assembly, respectively.

2. The airport runway lighting system of claim 1, wherein said male connector and female plug form part of a connection assembly built into each of said transformers.

3. The airport runway lighting system of claim 1, wherein each of said transformers includes two built-in female plugs and said male connector is formed by one of the two male connectors of a double male connector when the other of the two male connectors is placed in one of said female plugs of the transformer.

4. The airport runway lighting system of claim 1, wherein each of said transformers has a female plug base to connect a secondary cord coming from the lamp associated with said transformer.

5. The airport runway lighting system of claim 4, wherein said multiple assembly is attached in an upper part of a vertical wall of a manhole embedded in the ground by any fastening means whatsoever.

6. The airport runway lighting system of claim 1, wherein each of said transformers are torus shaped.

7. A multiple assembly of transformers for use in a runway lighting system of the type featuring a power source supplying a constant current to a primary circuit and a plurality of marking lights each connected to said primary circuit by a current transformer, the secondary winding of which supplies the lamp current;

wherein each of said transformers forms a single block featuring a male connector and a female plug, and said transformers are stacked together to form said multiple assembly, said male connector of one of the transformers being inserted into said female plug of the transformer immediately adjacent to it, the male connector of the first transformer of said multiple assembly and the male plug of the last transformer of said multiple assembly being connected in series to said primary circuit.

8. The multiple transformer assembly of claim 7, wherein said male connector and female plug form part of a connection assembly built into each of said transformers.

9. The multiple transformer assembly of claim 7, wherein each of said transformers includes two built-in female plugs and said male connector is formed by one of the two male connectors of a double male connector when the other of the two male connectors is placed in one of said female plugs of the transformer.

10. The multiple transformer assembly of claim 7, wherein each of said transformers has a female plug base to connect the secondary cord coming from the lamp associated with said transformer.

11. The multiple transformer assembly of claim 10, being attached in an upper part of a vertical wall of a manhole embedded in the ground by any fastening means whatsoever.

12. The multiple transformer assembly of claim 11, wherein said transformers are torus shaped.

* * * * *